United States Patent [19]

Nitschmann et al.

[11] Patent Number: 4,934,052

[45] Date of Patent: Jun. 19, 1990

[54] SAW CHAIN FOR A MOTOR-DRIVEN CHAIN SAW

[75] Inventors: Karl Nitschmann, Schorndorf; Werner Hartmann, Ostfildern, both of Fed. Rep. of Germany

[73] Assignee: Andreas Stihl, Waiblingen, Fed. Rep. of Germany

[21] Appl. No.: 286,749

[22] Filed: Dec. 19, 1988

[30] Foreign Application Priority Data

Dec. 17, 1987 [DE] Fed. Rep. of Germany ..... 3742739

[51] Int. Cl.[5] ..... B27B 17/12

[52] U.S. Cl. ..... 30/123.4; 30/383; 83/169; 83/830; 184/15.1

[58] Field of Search ..... 30/123.4, 123.3, 381, 30/383; 83/169, 820, 831, 832, 833, 834; 184/15.1, 15.2, 15.3, 16, 17

[56] References Cited

U.S. PATENT DOCUMENTS

| | | | |
|---|---|---|---|
| 1,397,026 | 11/1921 | Wolf | 30/123.4 |
| 2,622,636 | 12/1952 | Cox | 83/834 |
| 3,292,670 | 12/1966 | Ratz et al. | 30/123.4 |
| 3,478,787 | 11/1969 | Piller | 30/123.4 |
| 3,870,125 | 3/1975 | Gorski | 83/169 X |
| 4,434,556 | 3/1984 | Nitschmann et al. | 30/123.4 |

*Primary Examiner*—Frank T. Yost

*Assistant Examiner*—Rinaldi Rada

*Attorney, Agent, or Firm*—Walter Ottesen

[57] ABSTRACT

The invention is directed to a saw chain for a motor-driven chain saw equipped with a guide bar and for which lubricating oil is continuously supplied during operation. The oil reaches the guide groove of the guide bar and is directed to the pivotal joints of the saw chain. The oil is taken up by the foot portions of the center links of the saw chain which engage the guide groove. Groove-like channels are provided in a side face of these foot portions via which the lubricating oil is conducted to the pivotal joints. Lubricant pockets are provided in the foot portions of the center links of the saw chain which are supplementary to the channels so that the center links can take along a greater quantity of lubricant. This lubricant then reaches the pivotal joints through the channels especially at the forward end of the guide bar where the saw chain changes direction. This flow of the lubricant to the pivotal joints occurs at the turn-around location because of the centrifugal force which acts on the lubricant as the saw chain moves around the forward end of the guide bar so that an adequate lubrication is assured even at this forward region and also at the lower portion of the turn-around region where the cutting action of the saw chain takes place.

20 Claims, 4 Drawing Sheets

Fig. 6
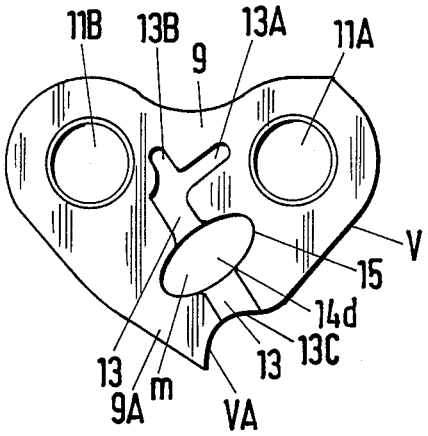
Fig. 5
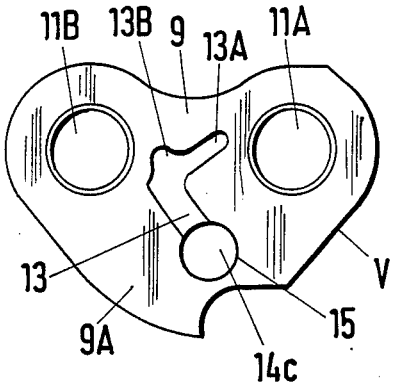
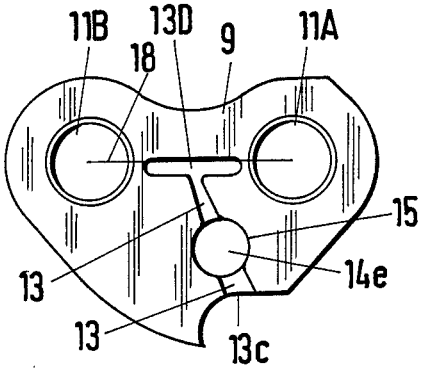
Fig. 7
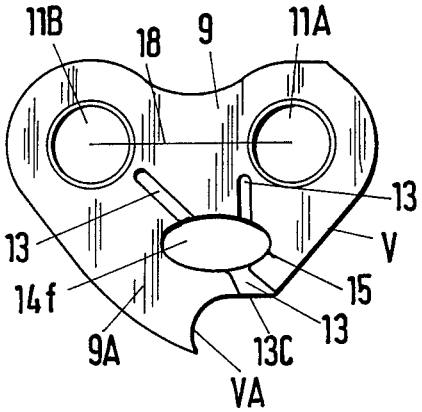
Fig. 8

SAW CHAIN FOR A MOTOR-DRIVEN CHAIN SAW

FIELD OF THE INVENTION

The invention relates to a saw chain for a motor-driven chain saw having a guide bar defining a guide groove in which the saw chain is guided. The guide bar has a periphery at which two mutually adjacent side walls are formed to conjointly define the guide groove. A feed bore is formed in one of the side walls for feeding a lubricant into the guide groove. The saw chain includes a plurality of center links and a plurality of side links pivotally interconnected by a plurality of rivets. Each of the center links has two rivet bores for accommodating respective rivets therein and further has a foot portion for engaging the guide groove. Each of the center links also has an elongated recess formed therein so as to extend upwardly from the foot portion to open at the vicinity of one of the rivet bores. The elongated recess conducts lubricant from the groove to at least one of the rivet bores.

BACKGROUND OF THE INVENTION

Saw chains of the kind described above are known in various configurations and are disclosed, for example, in U.S. Pat. Nos. 3,292,670; 3,478,787; and, 4,434,556. The center links of these saw chains have respective foot portions with which they engage in the guide groove of the guide bar and thereby come into contact with the lubricant which is introduced periodically into the guide groove through a feed bore in the groove wall. As the saw chain moves around the guide bar, the lubricant can enter the lubricant channels which open into the guide groove at the forward edges of the foot portions with these edges being viewed as the forward edges with respect to the direction of advance of the saw chain as it moves around the guide bar.

U.S. Pat. No. 3,292,670 discloses such a guide channel in each of the center links. The guide channel extends toward the rearward rivet bore of the center link where it opens with the rearward bore being rearward with respect to the advancing direction of the saw chain in its movement around the guide bar. The lubrication of the saw chains links is not complete in this saw chain because only one of the two rivet bores arranged one behind the other receives lubricant directly.

Another saw chain is disclosed in U.S. Pat. No. 3,478,787 wherein two lubricant channels are provided for each center link and these two channels lead to respective ones of the two rivet bores. However, the opening of the forward lubricant channel is at a considerable distance away from the bottom of the guide groove so that this channel and therefore the forward rivet bore are not supplied with the lubricant continuously and in adequate quantities.

A further saw chain is disclosed in U.S. Pat. No. 4,434,556 wherein the lubricant supply at both rivet bores of the center links is improved in that the lubricant channel is branched to both rivet bores. However, the oil quantity taken up from the guide groove is often inadequate for providing a sufficient supply of lubricant to the rivet bores because the lubricant channel cannot take up enough lubricating oil especially because only the region close to the feed bore is available for this purpose.

SUMMARY OF THE INVENTION

It is an object of the invention to provide a saw chain which is further improved so that lubricant is made available at the saw chain links over the largest possible working range of the saw chain. It is a further object of the invention to substantially prevent losses of lubricant.

According to a feature of the invention, the foot portion of each of the center links of the saw chain is provided with a lubricant pocket which defines a hollow space. This pocket communicates with an elongated lubricant channel also formed on the foot portion of the center link.

The lubricant pockets provided in the foot portions of the center links take up the lubricant in the vicinity of the feed bore and form a reservoir from which the lubricant channels can be supplied. The pockets and the lubricant channels have open sides and are disposed in a side surface of the foot portion. The pockets and lubricant channels are bounded by a wall of the guide groove during movement of the saw chain around the guide bar. For this reason, the lubricant taken up cannot flow into the guide groove in an unwanted manner; instead, the lubricant held in this manner forms a lubricant film on the corresponding side surfaces of the center links which causes the lubricant to be conducted toward the rivet bores.

The stored lubricant located in the pockets is for the most part transported up to the forward end of the guide bar. Since the saw chain is turned around at the end of the guide bar, the lubricant can flow out from the pockets into the channels under the action of centrifugal force and from there can reach the pivot joints defined by the rivets. These pivot joints can therefore be especially adequately lubricated at the lower portion of the end turnaround whereat the largest portion of the chain saw cutting operation occurs.

U.S. Pat. Nos. 1,397,026 and 2,622,636 disclose arrangements wherein the center link of a chain saw is provided with storage means for storing a lubricant. These storage means comprise felt slugs inserted into bores of selected saw chain links. However, these felt slugs are not located in the foot portions of the center links; instead, they are arranged in the outer region of the center links which is above the side walls of the guide groove. The felt must therefore either be saturated before each use of the motor-driven chain saw as disclosed in U.S. Pat. No. 2,622,636; or, special feed channels must be provided as disclosed in U.S. Pat. No. 1,397,026 which must be supplied via additional channels from a reservoir provided within the guide bar. However, a reliable lubrication via such channels is not assured and, furthermore, the complexity involved with the configuration of the guide bar and the center links is very substantial.

In contrast to the foregoing, the saw chain according to the invention provides lubricant pockets configured as hollow spaces which are filled directly via the feed bore in a wall of the guide groove or from the guide groove in the vicinity of this feed bore.

BRIEF DESCRIPTION OF THE DRAWINGS

The invention will now be described with reference to the drawings wherein:

FIG. 5 is a side elevation view of the center link which contains a lubricant pocket corresponding to that shown in FIGS. 4A or 4B;

FIG. 6 is a side elevation view of a center link provided with a lubricant pocket which is formed as a stamped impression in the foot portion thereof;

FIG. 7 is a side elevation view of a center link having a lubricant pocket with a circular periphery; and, FIG. 8 is a side elevation view of a center link provided with a lubricant pocket having an elliptical configuration.

DESCRIPTION OF THE PREFERRED EMBODIMENTS OF THE INVENTION

Figure 1:
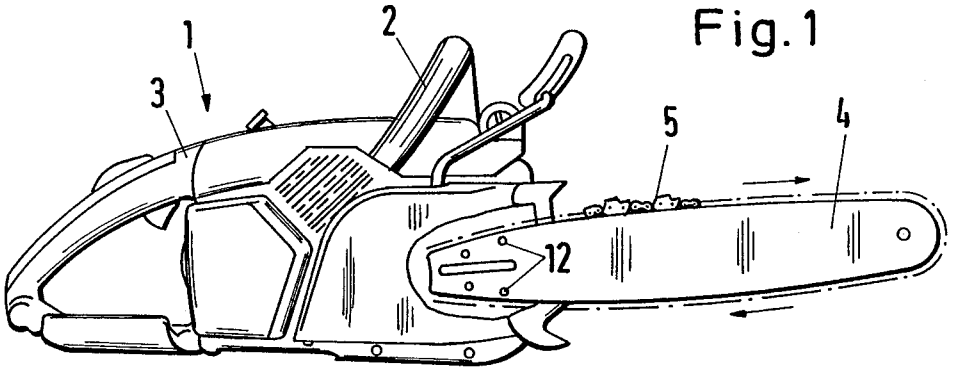
FIG. 1 is a schematic illustration of a motor-driven chain saw equipped with a guide bar and with a saw chain configured in the manner provided by the invention.

FIG. 1 is a schematic representation of a motor-driven chain saw 1 which shows the application of the saw chain according to the invention. The motor-driven chain saw is portable and has forward and rearward handles (2 and 3) as well as a guide bar 4 on which the saw chain 5 is driven by the motor.

Figure 2:
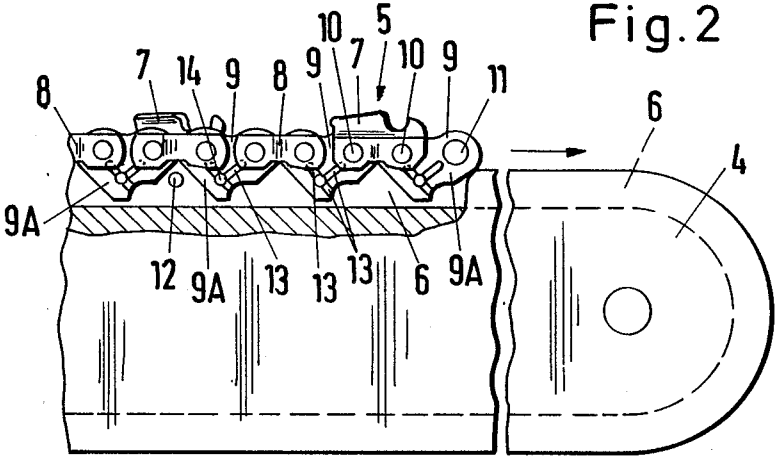
FIG. 2 shows a portion of the guide bar of the motor-driven chain saw of FIG. 1 together with a segment of an embodiment of the saw chain according to the invention.

FIG. 2 is a side elevation view of a portion of the guide bar of the chain saw shown in FIG. 1 with a side wall of the guide groove broken away to show a segment of the saw chain as well as the base of the guide groove. The saw chain comprises side links, namely cutting links 7 and connecting links 8, as well as center links 9 having foot portions 9A which engage in the guide groove 6. The depth of engagement of the foot portions 9A into the guide groove 6 is determined by the bearing plane at which the side links (7 and 8) glide on the end faces 6C of the side walls (6A and 6B) of the guide bar. The chain links are pivotally connected by means of rivets 10 and each link is provided with two rivet bores 11 for accommodating respective rivets 10. Three aligned rivet bores of the side and center links lying one next to the other are penetrated by a rivet 10 as shown in FIGS. 4A to 4D.

Figure 4D:
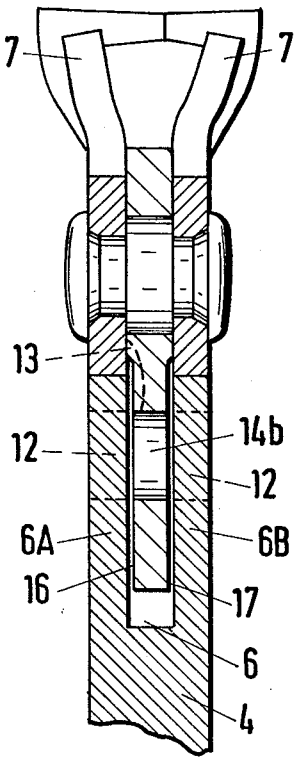
FIG. 4D corresponds to the view of FIG. 4A and shows a fourth embodiment of the center link of a saw chain according to the invention.
Figure 4C:
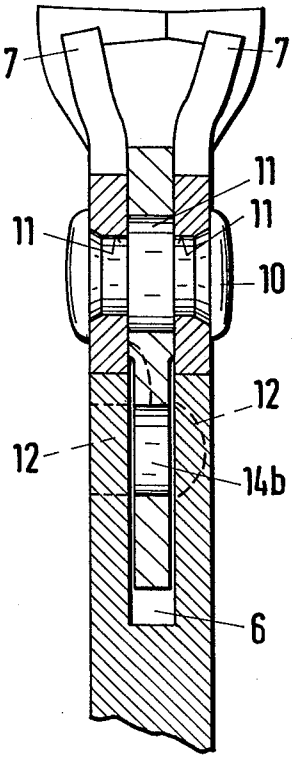
FIG. 4C corresponds to the view of FIG. 4A and shows a third embodiment of the center link of a saw chain of the invention.
Figure 4B:
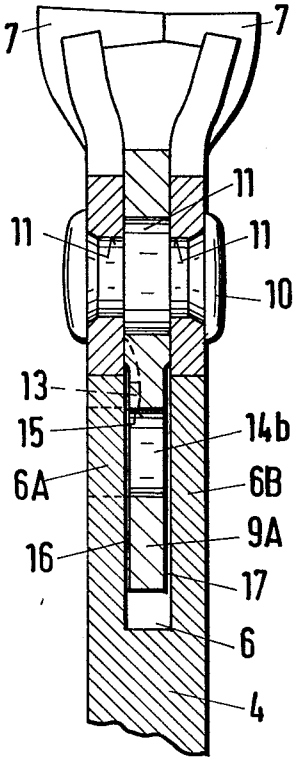
FIG. 4B corresponds to the view of FIG. 4A and shows a second embodiment of the center link of a saw chain of the invention.
Figure 4A:
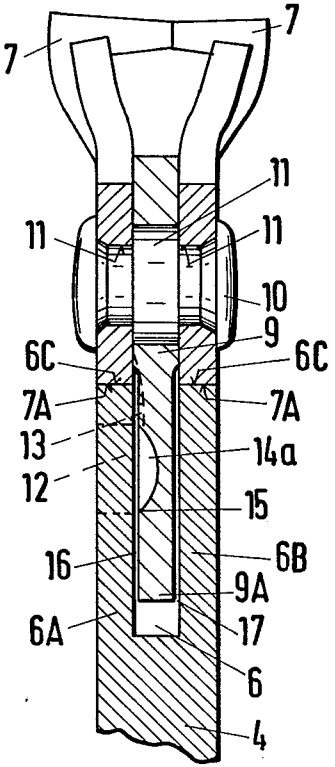
FIG. 4A is a section view taken along line IV—IV of FIG. 3 and shows the center link of a first embodiment of the saw chain of the invention.

A feed bore 12 is provided in the wall of the guide groove 6 which is preferably provided in only one of the two side walls (6A and 6B) of the guide groove as shown in FIGS. 4A and 4B. However, the feed bore can be provided in the opposite lying side wall 6B in the form of a blind bore as shown in FIG. 4C or as a through-bore as shown in FIG. 4D. The feed bore 12 which penetrates both side walls as shown in FIG. 4D is especially simple to manufacture and can be produced, for example, by stamping.

Figure 3:
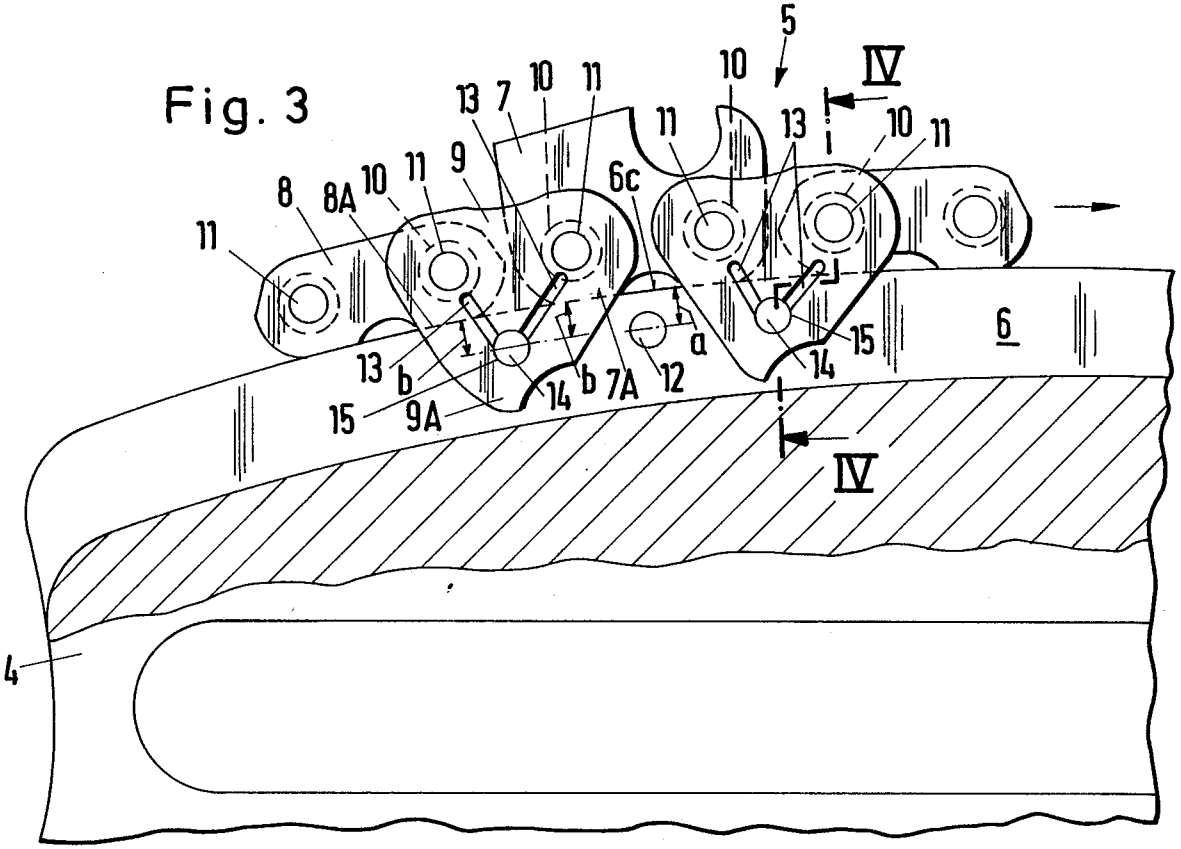
FIG. 3 is an enlarged view of a segment of the saw chain according to the invention taken through the longitudinal center plane of the guide bar.

Lubricating oil is introduced into the guide groove 6 continuously or periodically via the feed bore 12 during the operation of the motor-driven chain saw. This lubricant is intended to reach the pivot joints defined by the rivets 10 and rivet bores 11. For this purpose, the center links 9 are provided with lubricant channels 13 which are configured as elongated recesses in one of the two side faces of the center links. These elongated recesses can be formed, for example, by stamping and can be configured to have different paths in dependence upon the configuration of the saw chain. In each instance, one or more of such lubricant channels originate at a lubricant pocket 14 and terminate in the vicinity of corresponding ones of the rivet bores 11 as shown in FIGS. 2 and 3. The lubricant pockets 14 are configured in the foot portion 9A of each center link 9.

The feed bore 12 is preferably provided at the end of the guide bar 4 close to the housing of the chain saw. Preferably, the feed bore 12 is located where the links of the saw chain start their movement about the periphery of the guide bar. However, a further feed bore 12 can be provided at a location where the saw chain ends its movement around the periphery of the guide bar.

As shown in FIGS. 2 and 3, the lubricant pockets 14 of the center links 9 are shown in this embodiment to be approximately at the same elevation as the feed bore 12. For this purpose, the difference in elevation (b) measured from the center of the lubricant pocket 14 to the foot points 7A or 8A of the neighboring side links (7 and 8) is selected to be approximately the same as the elevation difference (a) between the center axis of the feed bore 12 and the end face 6C of the side wall with the elevation difference (b) being measured when the saw chain is in its extended position as shown in FIG. 3. For this reason, the lubricant pockets 14 can take up the introduced lubricant directly when passing the feed bore 12.

In addition or as an alternative, lubricant oil which first reaches the guide groove directly via the feed bore 12 can indirectly enter the lubricant pocket. For this purpose, one of the lubricant channels 13 can be led up to the end face of the foot portion 9A of the center link 9 so that the pocket is fed directly with lubricant from the guide groove via this channel portion. The lubricating center channel 13 is led to the forward end face of the foot portion 9A as viewed in the direction of movement of the saw chain (FIGS. 2, 6, 7 and 8). In this configuration, it is not necessary that the lubricant pockets 14 are located at the same elevation as the feed bore 12 as shown in FIGS. 2 and 3. Rather, the center links 9 can take up the lubricating oil out of the guide groove with their lower channel segments which then reaches the lubricant pockets. A precondition however, is that the guide groove be filled with lubricant to an adequately high level which in practice is easily possible in the vicinity of the feed bore 12.

FIGS. 4A to 4D show different embodiments for the lubricant pockets 14 and the feed bore 12 in correspondence to the section view taken along line IV—IV of FIG. 3. The feed bore 12 of FIG. 4D extends through both side walls 6A and 6B of the guide groove 6 and corresponds to the illustration shown in FIG. 3. The lubricant pockets 14 are each formed as a hollow space which is open at a particular side surface of the foot portion 9A of the center link. This side surface faces a corresponding one of the side walls of the guide groove 6 in which the feed bore 12 is located.

In the embodiment of FIG. 4A, the lubricant pocket 14a is a depression having the configuration of a portion of the circumference of a circle when viewed in side elevation. In this embodiment, the depression has an approximately shell-like shape. This depression 14a faces the side wall 6A of the guide groove 6 and has approximately the same diameter at its periphery 15 as the feed bore 12. The axes of the feed bore 12 and the pocket 14a are coincident when the feed bore 12 and pocket 14a are in aligned overlapping position relative to each other. Since the foot portion 9A of the center link 9 is spaced only a very small distance from both side walls (6A and 6B) of the groove 6, the lubricant taken up in the pocket 14a is for the most part held back and a lubricant film forms in the gap 16 between the side wall 6A and the foot portions 9A. The lubricating oil leaves the pocket 14a especially in the turn-around region of the saw chain under centrifugal force and flows via channels 13 to the rivet bores 11 and thereby to the pivot locations. Accordingly, these rivet locations are supplied with lubricant from the reservoir formed in the pocket as the saw chain moves around the guide bar with this reservoir being filled up with each complete movement of the chain around the guide bar.

In the embodiment of FIG. 4B, the lubricant pocket 14b is a cylindrical through-bore which can be made in an especially simple manner by boring or stamping. From this pocket 14b too, the lubricating oil can escape into the guide groove 6 in only small quantities because only a very narrow gap 17 is present between the side wall 6B of the guide groove and the foot portion 9A of the center link.

FIG. 4C shows that the feed bore 12 in the one side wall 6A of the guide groove 6 extends therethrough and is configured as a blind bore in the other side wall 6B so that the lubricant which is supplied under pressure to the feed bore 12 can also be collected in the side wall 6B and from there can be directed to the lubricant pockets 14b.

In FIG. 4D, the bore 12 is also a through-bore in side wall 6B which can be produced in a very simple manner during manufacture. However, lubricant losses can occur in this embodiment because some of the lubricating oil can escape out of bore 12 in the side wall 6B to the ambient but these losses lie within tolerable limits.

FIGS. 5 to 8 show different embodiments of the lubricating pockets and the lubricant channels corresponding thereto for four different center links 9.

In the embodiment of FIG. 5, the lubricant pocket 14c corresponds to FIG. 4A or FIG. 4B and is configured as a depression or bore having a circular periphery 15. From this pocket 14c, a lubricant channel 13 is led toward the rear (referred to the forward edge V of the center link) and in the direction toward the rearward rivet bore 11B. This channel has a branch 13A which is led up to the vicinity of the forward rivet bore 11A and from there a further branch 13B runs in the direction toward the rearward rivet bore 11B. The position of channel 13 is so selected that the centrifugal forces occurring during the movement of the saw chain around the guide bar support the feeding of the lubricating oil from the pocket 14c through the channel 13 so that the lubricating oil flows into the branches 13A and 13B without disturbance and thereby reaches the rivet bores.

In the embodiment of FIG. 6, the lubricant pocket 14d is preferably formed as a stamped impression in the foot portion 9A of the center link 9. The periphery 15 of pocket 14d is oval or elliptical with the channel 13 starting out at a segment of the periphery having the larger radius of curvature. This channel has a lower channel segment having an inlet 13C which lies at the arcuately-shaped portion VA of the forward edge V of the foot portion 9A. This inlet location 13C is especially suited for receiving lubricating oil from the guide groove. From the opposite lying segment of the periphery 15, the channel 13 runs in a manner similar to that shown in FIG. 5 and extends diagonally toward the rear and there has two branches (13A and 13B) with the branch 13B being somewhat longer and therefore reaching closer to the rearward rivet bore 11B. The lubricating pocket 14d is so arranged that its center point (m) has the spacing (b) from the lower edges of the side links in the manner discussed with respect to FIG. 3. This spacing (b) coincides with the mean distance (a) of the feed bore from the end face 6C of the guide groove.

The center link 9 of FIG. 7 has a lubricant pocket 14e having a circularly-shaped periphery 15 from which a lubricant channel 13 extends on the one hand to an inlet location 13C in a manner similar to that shown in FIG. 6 and, on the other hand, diagonally toward the rear. This segment of channel 13 lying opposite the inlet location is widened to improve taking up the lubricating oil at the transition location to the pocket 14e and in its remaining course, this channel 13 is tapered. Channel 13 opens up into a channel segment 13D at approximately the center region between the two rivet bores (11A and 11B). The channel segment 13D extends parallel to the connecting line 18 between the axes of the two rivet bores and has a course which bounds on this line. The two ends of the channel segment 13D lie in the vicinity of corresponding ones of the two rivet bores. In this embodiment too, the lubricant reservoir in the pocket 14e is additionally supplied via the opening 13C of channel 13 and supplies the rivet bores and the corresponding pivot connections with lubricating oil via the channel 13 with the aid of centrifugal forces.

FIG. 8 shows a further embodiment wherein the periphery 15 of the lubricant pocket 14f is configured so as to be elliptical with the longer axis of the ellipse being approximately parallel to the connecting line 18 between the axes of corresponding ones of the rivet bores 11A and 11B. The pocket 14f can likewise be formed as a recess by means of stamping; however, the pocket 14f can also be configured as a stamped hole. Two lubricant channels 13 extend from the section of the periphery 15 facing toward the connecting line 18 to respective ones of rivet bores (11A and 11B). In a manner similar to that described with respect to FIGS. 6 and 7, an inlet location 13C for the channel 13 is provided for additionally supplying the reservoir in the lubricant pocket 14f at the arcuately-shaped segment VA of the forward edge of the foot portion 9A. This inlet location lies at the transition of the edge segment VA into the straight line segment of the forward edge V. As with respect to the embodiment of FIG. 7, the channel 13 is continuously widened in the direction toward the inlet 13C so that a large quantity of lubricant can be taken up from the guide groove which then reaches the lubricant pocket 14f as a consequence of the inclined position of the channel and under the action of centrifugal forces.

Instead of being circular, oval or elliptical, the lubricant pockets can have corners in their contours and can, for example, be configured so as to be triangular, quadratic or elongated and rectangular or even polygonal.

The configuration is essentially dependent upon manufacturing conditions. The transition locations into the lubricant channel can lie at the corners of the periphery which is especially advantageous for the flow-over of the lubricating oil from and into the channels. Also, the lubricating pockets can be provided in the direction toward the transition locations in the channels such that they are tapered thereby providing a continuous transition from the pocket into the channel.

It is understood that the foregoing description is that of the preferred embodiments of the invention and that various changes and modifications may be made thereto without departing from the spirit and scope of the invention as defined in the appended claims.

What is claimed is:

1. A saw chain and guide bar combination for a motor-driven chain saw equipped with a drive motor for imparting a pulling force to the saw chain for moving the latter around the guide bar, the saw chain and guide bar combination comprising:

a guide bar having a periphery and two mutually adjacent side walls extending along said periphery thereof to conjointly define a guide groove for guiding the saw chain along the guide bar, the guide bar having an inner end in close proximity to the drive motor and an outer nose portion for passing the saw chain from the upper edge of the periphery to the lower edge thereof;

lubricant aperture means formed in at least one of said side walls at said inner end of said guide bar for conducting lubricant to said guide groove;

a plurality of center links and a plurality of side links, the links being pivotally interconnected by a plurality of forward rivets and a plurality of rearward rivets to define the saw chain;

each of said links including a plate-like body having a forward bore for accommodating one of said forward rivets and a rearward bore for accommodating one of said rearward rivets;

the plate-like body of each one of said center links having a foot portion for engaging said guide groove;

each one of said foot portions having a predetermined thickness and having two flat sides facing respective ones of said side walls as the saw chain moves along said periphery;

one of said flat sides defining a flat surface and having an elongated lubricant channel formed therein to a depth below said flat surface and less than said thickness for receiving lubricant introduced into said guide groove, said channel being formed in said one flat side so as to open at the vicinity of one of said rivet bores;

said one flat side of each of said foot portions further including a lubricant pocket formed therein in spaced relationship to said rivet bores and communicating with said lubricant channel;

said lubricant pocket being formed in said foot portion as a clear through unobstructed opening so as to extend from said one flat side to the other flat side so as to have a side wall defining a hollow reservoir space for receiving a supply of lubricant therein at said inner end of said guide bar from the lubricant supplied from said lubricant aperture means and for transporting said supply of lubricant along the guide bar to said nose portion where the centrifugal force developed at said nose portion causes the oil in said pocket to flow therefrom along said channel to the one rivet bore.

2. The combination of claim 1, each one of said side links having a pair of foot points and said plurality of side links being grouped into first and second groups of side links corresponding to respective ones of said side walls; said side walls having respective top end faces for contact engaging the side links of corresponding ones of said first and second groups at said foot points as the saw chain moves around the guide bar; said aperture means being a bore having a center disposed at a predetermined distance (a) from the top end face of said one side wall; and, each of said pockets being located at an elevation distance (b) from said foot points which is approximately equal to said predetermined distance (a).

3. A saw chain for a motor-driven chain saw equipped with a guide bar and drive motor for imparting a pulling force to the saw chain for moving the latter around the guide bar, the guide bar having a periphery and two mutually adjacent side walls extending along said periphery thereof to conjointly define a guide groove for guiding the saw chain along the guide bar, lubricant aperture means formed in at least one of said side walls for conducting lubricant to said guide groove, the saw chain comprising:

a plurality of center links and a plurality of side links, the links being pivotally interconnected by a plurality of forward rivets and a plurality of rearward rivets to define the saw chain;

each of said links including a plate-like body having a forward bore for accommodating one of said forward rivets and a rearward bore for accommodating one of said rearward rivets;

the plate-like body of each one of said center links having a foot portion for engaging said guide groove;

each one of said foot portions having two flat sides facing respective ones of said side walls as the saw chain moves along said periphery;

one of said flat sides defining a flat surface and having an elongated lubricant channel formed therein to a first depth below said flat surface for receiving lubricant introduced into said guide groove, said channel being formed in said one flat side so as to open at the vicinity of one of said rivet bores;

said one flat side of each of said foot portions further including a lubricant pocket formed therein and communicating with said lubricant channel;

said lubricant pocket being formed in said one flat side to a second depth greater than said first depth and so as to have a side wall defining a hollow reservoir space for holding a supply of lubricant therein; and, said side wall of said lubricant pocket and said flat surface conjointly defining a substantially uninterrupted peripheral edge; and, said hollow space being bounded by said peripheral edge at said flat surface and being open toward said side wall facing said one flat side;

each one of said side links having a pair of foot points and said plurality of side links being grouped into first and second groups of side links corresponding to respective ones of said side walls;

said side walls having respective top end faces for contact engaging the side links of corresponding ones of said first and second groups at said foot points as the saw chain moves around the guide bar;

said aperture means being a bore having a center disposed at a predetermined distance (a) from the top end face of said one side wall; and, each of said pockets being located at an elevation distance (b) from said foot points which is approximately equal to said predetermined distance (a).

4. The saw chain of claim 3, each of said lubricant pockets being configured as a depression in the foot portion of the center link corresponding thereto.

5. The saw chain of claim 3, said peripheral edge having a circular contour.

6. The saw chain of claim 3, said peripheral edge having an approximately elliptical contour.

7. The saw chain of claim 6, said elongated lubricant channel defining a longitudinal axis, said elliptical contour defining a long axis; and, said pocket opening into said lubricant channel and being orientated with respect to said lubricant channel so as to cause said axes to be approximately perpendicular to each other.

8. The saw chain of claim 3, each of said center links having a forward edge facing in the direction of movement around the guide bar and having a rearward edge facing away from said direction; said elongated lubricant channel having an inlet at said forward edge; and, said elongated lubricant channel extending rearwardly away from said inlet opening to communicate with said lubricant pocket; and, said lubricant channel extending upwardly so as to be inclined with respect to said direction.

9. A saw chain for a motor-driven chain saw equipped with a guide bar and drive motor for imparting a pulling force to the saw chain for moving the latter around the guide bar, the guide bar having a periphery and two mutually adjacent side walls extending along said periphery thereof to conjointly define a guide groove for guiding the saw chain along the guide bar, lubricant aperture means formed in at least one of said side walls for conducting lubricant to said guide groove, the saw chain comprising:

a plurality of center links and a plurality of side links, the links being pivotally interconnected by a plurality of forward rivets and a plurality of rearward rivets to define the saw chain;

each of said links including a plate-like body having a forward bore for accommodating one of said forward rivets and a rearward bore for accommodating one of said rearward rivets;

the plate-like body of each one of said center links having a foot portion for engaging said guide groove;

each one of said foot portions having two flat sides facing respective ones of said side walls as the saw chain moves along said periphery;

one of said flat sides defining a flat surface and having an elongated lubricant channel formed therein to a first depth below said flat surface for receiving lubricant introduced into said guide groove, said channel being formed in said one flat side so as to open at the vicinity of one of said rivet bores;

said one flat side of each of said foot portions further including a lubricant pocket formed therein and communicating with said lubricant channel;

said lubricant pocket being formed in said one flat side to a second depth greater than said first depth and so as to have a side wall defining a hollow reservoir space for holding a supply of lubricant therein; and, said side wall of said lubricant pocket and said flat surface conjointly defining a substantially uninterrupted peripheral edge; and, said hollow space being bounded by said peripheral edge at said flat surface and being open toward said side wall facing said one flat side;

each of said center links having a forward edge facing in the direction of movement around the guide bar and having a rearward edge facing away from said direction; said elongated lubricant channel having an inlet at said forward edge; said elongated lubricant channel extending rearwardly away from said inlet opening to communicate with said lubricant pocket; and, said lubricant channel extending upwardly so as to be inclined with respect to said direction; and, each of said center links further including two branch channels extending from said lubricant pocket toward respective ones of said forward and rearward rivet bores.

10. A saw chain for a motor-driven chain saw equipped with a guide bar and drive motor for imparting a pulling force to the saw chain for moving the latter around the guide bar, the guide bar having a periphery and two mutually adjacent side walls extending along said periphery thereof to conjointly define a guide groove for guiding the saw chain along the guide bar, lubricant aperture means formed in at least one of said side walls for conducting lubricant to said guide groove, the saw chain comprising:

a plurality of center links and a plurality of side links, the links being pivotally interconnected by a plurality of forward rivets and a plurality of rearward rivets to define the saw chain;

each of said links including a plate-like body having a forward bore for accommodating one of said forward rivets and a rearward bore for accommodating one of said rearward rivets;

the plate-like body of each one of said center links having a foot portion for engaging said guide groove;

each one of said foot portions having two flat sides facing respective ones of said side walls as the saw chain moves along said periphery;

one of said flat sides defining a flat surface and having an elongated lubricant channel formed therein to a first depth below said flat surface for receiving lubricant introduced into said guide groove, said channel being formed in said one flat side so as to open at the vicinity of one of said rivet bores;

said one flat side of each of said foot portions further including a lubricant pocket formed therein and communicating with said lubricant channel;

said lubricant pocket being formed in said one flat side to a second depth greater than said first depth and so as to have a side wall defining a hollow reservoir space for holding a supply of lubricant therein; and, said side wall of said lubricant pocket and said flat surface conjointly defining a substantially uninterrupted peripheral edge; and, said hollow space being bounded by said peripheral edge at said flat surface and being open toward said side wall facing said one flat side;

each of said center links having a forward edge facing in the direction of movement around the guide bar and having a rearward edge facing away from said direction; said elongated lubricant channel having an inlet at said forward edge; and, said elongated lubricant channel extending rearwardly away from said inlet opening to communicate with said lubricant pocket; and, said lubricant channel extending upwardly so as to be inclined with respect to said direction;

said elongated lubricant channel extending from said pocket toward said rearward rivet bore; and, each of said center links further including a first branch channel extending from said elongated lubricant channel toward said forward rivet bore.

11. The saw chain of claim 10, each of said center links further including a second branch channel extending from said first branch channel toward said rearward rivet bore.

12. A saw chain for a motor-driven chain saw equipped with a guide bar and drive motor for imparting a pulling force to the saw chain for moving the latter around the guide bar, the guide bar having a periphery and two mutually adjacent side walls extending along said periphery thereof to conjointly define a guide groove for guiding the saw chain along the guide bar, lubricant aperture means formed in at least one of said side walls for conducting lubricant to said guide groove, the saw chain comprising:

a plurality of center links and a plurality of side links, the links being pivotally interconnected by a plurality of forward rivets and a plurality of rearward rivets to define the saw chain;

each of said links including a platelike body having a forward bore for accommodating one of said forward rivets and a rearward bore for accommodating one of said rearward rivets;

the plate-like body of each one of said center links having a foot portion for engaging said guide groove;

each one of said foot portions having two flat sides facing respective ones of said side walls as the saw chain moves along said periphery;

one of said flat sides defining a flat surface and having an elongated lubricant channel formed therein to a first depth below said flat surface for receiving lubricant introduced into said guide groove, said channel being formed in said one flat side so as to open at the vicinity of one of said rivet bores;

said one flat side of each of said foot portions further including a lubricant pocket formed therein and communicating with said lubricant channel;

said lubricant pocket being formed in said one flat side to a second depth greater than said first depth and so as to have a side wall defining a hollow reservoir space for holding a supply of lubricant therein; and, said side wall of said lubricant pocket and said flat surface conjointly defining a substantially uninterrupted peripheral edge; and, said hollow space being bounded by said peripheral edge at said flat surface and being open toward said side wall facing said one flat side;

the forward and rearward rivet bores of each of said center links having a mid point therebetween and defining respective pivot axes; each of said center links further including a channel segment formed in said one face thereof so as to extend approximately parallel to a straight line passing through said pivot axes; and, said elongated lubricant channel extending from said lubricant pocket and toward the mid point between said forward and rearward bores so as to communicate with said channel segment.

13. A saw chain for a motor-driven chain saw equipped with a guide bar and drive motor for imparting a pulling force to the saw chain for moving the latter around the guide bar, the guide bar having a periphery and two mutually adjacent side walls extending along said periphery thereof to conjointly define a guide groove for guiding the saw chain along the guide bar, lubricant aperture means formed in at least one of said side walls for conducting lubricant to said guide groove, the saw chain comprising:

a plurality of center links and a plurality of side links, the links being pivotally interconnected by a plurality of forward rivets and a plurality of rearward rivets to define the saw chain;

each of said links including a plate-like body having a forward bore for accommodating one of said forward rivets and a rearward bore for accommodating one of said rearward rivets;

the plate-like body of each one of said center links having a foot portion for engaging said guide groove;

each one of said foot portions having two flat sides facing respective ones of said side walls as the saw chain moves along said periphery;

one of said flat sides defining a flat surface and having an elongated lubricant channel formed therein to a first depth below said flat surface for receiving lubricant introduced into said guide groove, said channel being formed in said one flat side so as to open at the vicinity of one of said rivet bores;

said one flat side of each of said foot portions further including a lubricant pocket formed therein and communicating with said lubricant channel;

said lubricant pocket being formed in said one flat side to a second depth greater than said first depth and so as to have a side wall defining a hollow reservoir space for holding a supply of lubricant therein; and, said side wall of said lubricant pocket and said flat surface conjointly defining a substantially uninterrupted peripheral edge; and, said hollow space being bounded by said peripheral edge at said flat surface and being open toward said side wall facing said one flat side;

said lubricant aperture means being a lubricant bore; and, said lubricant pocket having a periphery so as to cause said pocket and said bore to be in aligned overlapping relationship to each other when said center links pass said lubricant bore.

14. The saw chain of claim 13, each of said side walls having a wall surface facing toward a corresponding one of the flat sides of each of said foot portions of each of said center links; and, said foot portion of each of said center links having a thickness which is dimensioned so as to cause a very narrow first gap to be formed between the wall surface of one of said side walls and one of said flat sides and so as to cause a very narrow second gap to be formed between the wall surface of said other side wall and the other one of said flat sides.

15. A saw chain and guide bar combination for a motor-driven chain saw equipped with a drive motor for imparting a pulling force to the saw chain for moving the latter around the guide bar, the saw chain and guide bar combination comprising:

a guide bar having a periphery with upper and lower edges and two mutually adjacent side walls extending along said periphery to conjointly define a guide groove for guiding the saw chain along the guide bar, the guide bar having an outer nose portion for passing the saw chain from the upper edge of the periphery to the lower edge thereof, lubricant aperture means formed in at least one of said side walls at a location remote from said nose portion for conducting lubricant to said guide groove;

a plurality of center links and a plurality of side links, the links being pivotally interconnected by a plurality of forward rivets and a plurality of rearward rivets to define the saw chain;

each of said links including a plate-like body having a forward bore for accommodating one of said forward rivets and a rearward bore for accommodating one of said rearward rivets;

the plate-like body of each one of said center links having a foot portion for engaging said guide groove;

each one of said foot portions having two flat sides facing respective ones of said side walls as the saw chain moves along said periphery;

one of said flat sides defining a flat surface and having an elongated lubricant channel formed therein to a first depth below said flat surface for receiving lubricant introduced into said guide groove, said channel being formed in said one flat side so as to open at the vicinity of one of said rivet bores;

said one flat side of each of said foot portions further including a lubricant pocket formed therein in spaced relationship to said rivet bores and communicating with said lubricant channel;

said lubricant pocket being formed in said one flat side to a second depth greater than said first depth and so as to have a side wall defining a hollow unobstructed reservoir space for holding a supply of lubricant therein and for transporting the supply of lubricant from said location to said nose portion where the centrifugal force developed at said nose portion causes the oil in said pocket to flow therefrom along the lubricant channel to the one rivet bore;

said side wall of said lubricant pocket and said flat surface conjointly defining a substantially uninterrupted peripheral edge; and, said hollow space being bounded by said peripheral edge at said flat surface and being open toward said side wall facing said one flat side.

16. The saw chain of claim 15, said peripheral edge having a circular contour.

17. The saw chain of claim 15, said peripheral edge having an approximately elliptical contour.

18. The saw chain of claim 17, said elongated lubricant channel defining a longitudinal axis, said elliptical contour defining a long axis; and, said pocket opening into said lubricant channel and being orientated with respect to said lubricant channel so as to cause said axes to be approximately perpendicular to each other.

19. A saw chain for a motor-driven chain saw equipped with a guide bar and drive motor for imparting a pulling force to the saw chain for moving the latter around the guide bar, the guide bar having a periphery with upper and lower edges and two mutually adjacent side walls extending along said periphery to conjointly define a guide groove for guiding the saw chain along the guide bar, the guide bar having an outer nose portion for passing the saw chain from the upper edge of the periphery to the lower edge thereof, lubricant aperture means formed in at least one of said side walls at a location remote said nose portion for conducting lubricant to said guide groove, the saw chain comprising:

a plurality of center links and a plurality of side links, the links being pivotally interconnected by a plurality of forward rivets and a plurality of rearward rivets to define the saw chain;

each of said links including a plate-like body having a forward bore for accommodating one of said forward rivets and a rearward bore for accommodating one of said rearward rivets;

the plate-like body of each one of said center links having a foot portion for engaging said guide groove;

each one of said foot portions having two flat sides facing respective ones of said side walls as the saw chain moves along said periphery;

one of said flat sides defining a flat surface and having an elongated lubricant channel formed therein to a first depth below said flat surface for receiving lubricant introduced into said guide groove, said channel being formed in said one flat side so as to open at the vicinity of one of said rivet bores;

said one flat side of each of said foot portions further including a lubricant pocket formed therein and communicating with said lubricant channel;

said lubricant pocket being formed in said one flat side to a second depth greater than said first depth and so as to have a side wall defining a hollow reservoir space for holding a supply of lubricant therein and for transporting the supply of lubricant from said location to said nose portion where the centrifugal force developed at said nose portion causes the oil in said pocket to flow therefrom along the lubricant channel to the one rivet bore;

said side wall of said lubricant pocket and said flat surface conjointly defining a substantially uninterrupted peripheral edge; and, said hollow space being bounded by said peripheral edge at said flat surface and being open toward said side wall facing said one flat side;

each one of said side links having a pair of foot points and said plurality of side links being grouped into first and second groups of side links corresponding to respective ones of said side walls;

said side walls having respective top end faces for contact engaging the side links of corresponding ones of said first and second groups at said foot points as the saw chain moves around the guide bar;

said aperture means being a bore having a center disposed at a predetermined distance (a) from the top end face of said one side wall; and, each of said pockets being located at an elevation distance (b) from said foot points which is approximately equal to said predetermined distance (a).

20. The saw chain of claim 19, each of said lubricant pockets being configured as a clear through unobstructed opening extending between the two flat sides of the foot portion of the center link corresponding thereto.

* * * * *